United States Patent [19]

Santiago et al.

[11] 4,190,762

[45] Feb. 26, 1980

[54] ADJUSTABLE GAP ELECTRODE ARRANGEMENT FOR ELECTROLYTICALLY HEATED STEAM IRON

[75] Inventors: Romeo S. Santiago, San Marino; Llewellyn Decker, Upland, both of Calif.

[73] Assignee: General Electric Company, New York, N.Y.

[21] Appl. No.: 924,911

[22] Filed: Jul. 17, 1978

[51] Int. Cl.[2] ..... H05B 3/60; D06F 75/16; F22B 1/30

[52] U.S. Cl. ..... 219/245; 38/69; 38/77.7; 38/85; 219/275; 219/289; 219/293; 338/83

[58] Field of Search ..... 219/271–276, 219/284–295, 245, 254; 338/80–86; 239/136; 68/222; 38/69, 74, 77.1–77.9, 82, 85, 88

[56] References Cited

U.S. PATENT DOCUMENTS

| | | | |
|---|---|---|---|
| 2,755,372 | 7/1956 | Fisher et al. | 219/275 |
| 2,861,365 | 11/1958 | Block | 219/245 X |
| 3,053,964 | 9/1962 | Foley et al. | 219/285 |
| 3,105,894 | 10/1963 | Matz et al. | 219/288 X |
| 3,308,267 | 3/1967 | Fenstermaker | 219/290 |
| 3,398,261 | 8/1968 | Mays | 219/285 |
| 3,493,723 | 2/1970 | Popeil | 219/275 X |
| 3,695,066 | 10/1972 | Doyel | 219/288 X |
| 3,755,649 | 8/1973 | Osrow | 219/288 X |
| 3,809,856 | 5/1974 | Wills | 219/286 |
| 3,969,607 | 7/1976 | Osrow et al. | 219/284 X |

FOREIGN PATENT DOCUMENTS

| | | | |
|---|---|---|---|
| 935130 | 1/1948 | France | 219/293 |

*Primary Examiner*—A. Bartis

*Attorney, Agent, or Firm*—John F. Cullen; George R. Powers; Leonard J. Platt

[57] ABSTRACT

A lightweight plastic electrolytic steam iron has a soleplate with steam distributing means therefrom and a casing of electrically non-conducting material forming the walls of an internal water tank coextensive with and extending over the soleplate. Spaced electrodes are supported in the tank to generate steam from the water therein and an insulated steam conduit extends from the soleplate upwardly into the tank to direct saturated steam from the tank through the steam distributing means to the surface being ironed. The spaced electrodes comprise a pair of adjacent parallel electrode plates disposed in the tank and spaced from the tank walls and from each other with the plates generally being vertical to the soleplate of the iron. A structure is connected to control the spacing between the plates from the iron handle and separate spaced stop posts are provided to limit movement of each plate to avoid contact therebetween. Plate area reducing structure is provided for each plate and includes making one of the plates shorter than the other to provide an extension on the other plate for contacting the stop post and also providing a cut-out notch on the other plate adjacent the stop post of the shorter plate. The entire purpose is to prevent mineral buildup and arcing between the plates and the stops.

7 Claims, 3 Drawing Figures

ADJUSTABLE GAP ELECTRODE ARRANGEMENT FOR ELECTROLYTICALLY HEATED STEAM IRON

BACKGROUND OF THE INVENTION

1. Field of the Invention

This invention relates to a lightweight steam iron made of plastic material and of the electrolytic version wherein steam is generated by applying current to internal electrodes to provide saturated steam to the ironing surface. A specific arrangement is provided in the structure of the spaced electrodes which, in combination with stop means and plate-area reducing means for each plate, cooperate to prevent mineral build-up and arcing between the plates and stop means.

2. Description of the Prior Art

Irons using plastic for as many parts as possible have come into general use. Typically, such irons may be electrolytic wherein a molded plastic casing contains an internal water tank with spaced electrodes generating steam and a soleplate integral with the water tank is provided as shown in U.S. Pat. Nos. 3,755,649 and 3,969,607. Such irons use plastic soleplates of appropriate material and some can be operable horizontally as an iron, or vertically as a steamer, as shown in U.S. Pat. No. Re 28,418. Such irons or steamers use the plastic soleplate as one side of the tank wall to abut the internal water tank directly against the soleplate whereby its temperature is limited to the temperature of the water. This also permits the use of many different types of plastic soleplates and is generally the type of U.S. Pat. No. Re 28,418. Such arrangements do not permit the use of metallic soleplates because of sealing difficulties even though metallic soleplates may be preferred to permit operation at higher temperatures needed in many ironing operations. A structure permitting this is shown in application Ser. No. 884,765 filed Mar. 9, 1978 of common assignment. Additionally, electrolytic steam generation is common in other than iron applications and usually involves the use of an electrolyte solution with spaced electrodes in one form of another. One of the difficulties has always been the mineral build-up on the plates causing shorting or arcing and this has been reduced in iron applications in some irons by the use of wire electrodes. However, plate electrodes provide much greater steam generating area and are thus desirable as shown in said copending application. There is a need for a special structural arrangement of such electrode plates in an iron combination to provide characteristics necessary for successful operation of an electrolytic iron using plates that can successfully overcome the deficiencies of a build-up of mineral deposits that may later become conductive and result in electrical flash-over that would erode the plates to an unacceptable level. An arrangement is desired where barriers in the form of stops are needed which must, by themselves, not serve as flash-over pathways and such arrangement must provide that every potential source of conduction through the mineral build-ups is neutralized or avoided.

SUMMARY OF THE INVENTION

It is an object of this invention to provide a lightweight electrolytic steam iron of plastic construction whereby the electrode plates are arranged in a specific formation to avoid any mineral build-up and consequent flashover.

Another object is to provide such an iron where the electrode arrangement provides for large capacity steam generation and is designed to minimize or avoid any electrical flashovers while permitting variable steam generation.

Briefly described, there is provided a lightweight steam iron having a soleplate with steam distributing means in its outer surface and a casing of electrically non-conducting material forming an internal water tank that is coextensive with and over the soleplate. Spaced electrodes are supported within the tank, preferably towards the rear, to generate steam from the water, and an insulated steam conduit extends from the soleplate upwardly into the tank for directing saturated steam from the tank through the steam distributing means to the surface being ironed. To this general combination, an improvement is provided in the electrode structure wherein the spaced electrodes comprise a pair of adjacent parallel plates in the tank, generally vertically to the tank bottom and spaced from the tank walls and from each other. While one or both may be movable, it is preferable to have one of the plates fixed in the tank and the other plate connected to be movable from the handle with respect to the fixed plate to vary the steam generating capacity. Stop means are provided to limit movement of both plates to avoid any contact therebetween, also plate area-reducing means is provided for each plate in the form of an extension on the movable plate and a notched cut-out on the same plate. Both means are adjacent a stop means. The arrangement prevents mineral build-up and arcing or flash-over between the plates and the necessary stop means. Thus, the main object of the invention is to provide a lightweight plastic steam iron that generates steam electrolytically, uses few parts, and introduces a form of electrode structure that maximizes steam generation while minimizing or avoiding the consequences of any mineral build-ups causing shorting or flashing over between the electrode plates.

DESCRIPTION OF THE PREFERRED EMBODIMENT

The invention is described in connection with a lightweight steam iron that uses a conventional aluminum soleplate modified for the invention although it will be appreciated that it is applicable to any iron using adjoining plastic parts of the general type shown in said copending application, Ser. No. 884,765 filed Mar. 9, 1978, of common assignment. While the structure to be described is most applicable to lightweight plastic irons of the electrolytic version and will be described in connection therewith, it may be applicable to any fluided boiler iron of the electrolytic type as will be apparent. Referring first of FIG. 1, there is shown an electric steam iron that includes a soleplate 10 that may employ a plurallity of ports to direct steam to the soleplate for steaming fabrics while ironing in the conventional manner. As shown, it uses a single insulated steam conduit 12, that is preferably plastic, to direct generated steam out a single port generally indicated at 14 that connects with steam distributing means 16 that take the form of well-known channels in the soleplate. The channels fan out from port 14 as steam distributing means to spread the steam over a larger area in the soleplate. The channels are cast or molded into the underside of the soleplate in a well-known manner.

Figure 1:
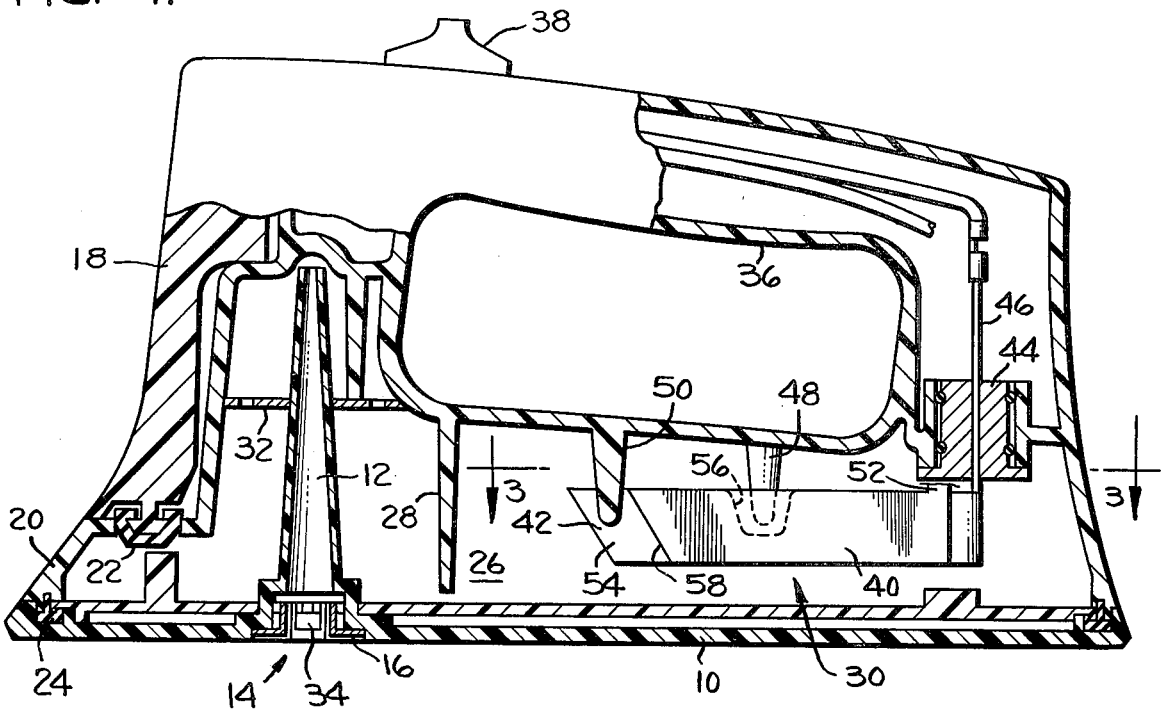
FIG. 1 is an elevation cross-section, partially broken, showing the invention applied to a plastic iron.

The iron is provided with a molded plastic casing 18 forming an exterior wall positioned above an intermediate plastic mamber 20 and sealed thereto by a watertight clamping seal 22, the intermediate member in turn being connected to soleplate 10 and sealed thereto by suitable sealing means 24 with the soleplate being either metallic or plastic as preferred. Intermediate plastic member 20 is disposed directly above the soleplate and is substantially coextensive with the soleplate to form a skirt around it and it is spaced from the soleplate as shown and supported thereon by the sealing means 24. For providing steam, an internal water tank 26 may be partially formed by the wall of casing 18 and plastic member 20 which may also be part of the casing. The general arrangement is not significant except that the internal tank 26 is formed directly out of the plastic and extends over the entire soleplate to be coextensive therewith as shown in FIG. 1. Suitable baffle means 28 is molded in the tank for dampening surges in the water. The heating structure for generating steam from the water in the tank comprises spaced electrodes, generally indicated at 30, that are supported within the tank and, as well known, heat is created by the passage of current between the electrodes which, preferably, are supported in the rear of the iron so that they are at least partially immersed in the water at all times whether the iron is flat or in a vertical position to insure steam generation for either ironing or for use of the device as a steamer. The electrodes are partially submerged in a water solution that contains dissolved salts to improve the ionization and form a good electrolyte in a well known manner.

For preventing the carryover of water drops from the boiling water in tank 26, a suitable apertured partition 32 is provided in the upper part of the tank surrounding elongated insulated steam conduit 12 which is open at the top and extends upwardly from the soleplate into the tank. Thus, steam formed by boiling water in the tank is saturated steam which rises and, under pressure is forced down conduit 12 and through a filter 34 in the conduit upstream of the distributing channel means 16, then to the channel means and then to the fabric being ironed. The iron has an open or closed handle 36 with a control button 38 that connects the heating circuit and may also be used to control the steam generation by suitable internal linkage as will become apparent. Thus, button 38 connects the circuit through an electric cord not shown to activate and control the electrodes 30 and generate heat and steam.

Figure 2:
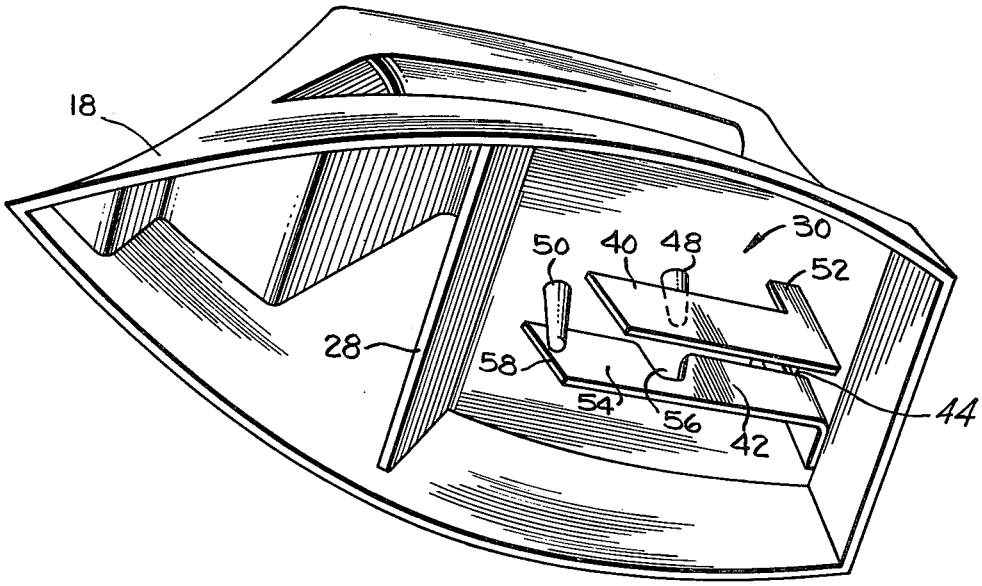
FIG. 2 is a perspective from below with the soleplate removed and showing the electrode construction.
Figure 3:
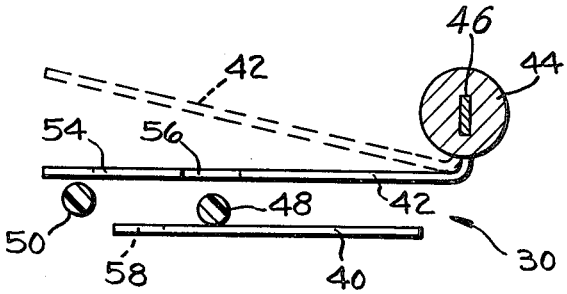
FIG. 3 is a partial view on line 3—3 of FIG. 1 showing electrode positions in solid and dotted lines and omitting the soleplate.

Normally, in electrolytic irons it is customary to use round wire electrodes or flat plate electrodes in various formations. The difficulty with round wire electrodes is the lack of capacity or large area necessary to create sufficient steam generation. Plain flat plate electrodes provide a large area for the build-up of mineral deposits that can result in arcing or flashover to short out the electrical system. Thus, the instant invention is directed to an improved electrode subassembly in an electrolytic iron. To this end, for generating steam, the electrodes 30 comprise a pair of adjacent parallel electrode plates 40 and 42. The plates are disposed in the water tank 26 to extend vertically across the tank, preferably longitudinally as shown in FIGS. 1 and 2, with respect to the tank bottom and are of unequal area. One electrode plate 40 is shorter in length across or along the tank and fixed with respect to the electrode plate 42. Plate 42 is longer and is pivotable or rotatable around a bearing 44 and operable through a suitable connection 46. The connection extends into the handle for operation by button 38 or other suitable means whereby plate 42 may be rotated between a minimum fixed parallel position as shown in FIGS. 2 and 3 to intermediate other variable positions as shown dotted in FIG. 3. Thus, the rotatable plate 42 may be turned with respect to the fixed plate 40 so that the steam generation rate may be varied from the maximum parallel solid lines position in FIGS. 2 and 3, to any selected more open dotted position as shown in FIG. 3 for lower steam rates.

Because of the tendency of arcing or flashover between the plates, it is desirable to limit the movement of the plates to avoid any contact therebetween. This is ensured by the provision of a pair of spaced stops in the form of posts with one post 48 and the other post 50 being formed directly in the casing 18 as molding extensions thereof as seen in FIG. 1. The fixed plate 40 may be secured directly in the casing molding by staking it therein at 52 or any other suitable manner so that it is stationary with respect to the rotatable plate 42 and its fixed position is enhanced by abutment with the post 48 so there is no movement whatever of plate 40. Similarly, the other post 50 provides a positive abutment for plate 42 to establish the minimum spacing between the plates and provide for parallelism thereof as seen in FIG. 3.

Normally the provision of posts 48 and 50 provide means by which mineral deposits may build-up and cause arcing or flashover between the plates. To positively avoid this undesired effect, a pair of area reducing means is provided on the plates with one opposite each adjacent post of the adjacent plate. As seen in FIG. 2, the difference in the plate length, with plate 40 being shorter than plate 42, in effect, provides an extension 54 on the movable plate 42 which abuts post 50. Thus, in effect, the reduced area at this point on the shorter plate 40 is disposed adjacent post 50 of adjacent plate 42 with the effect that post 50 is sitting out in the open safely removed from the plate 40 and any mineral build-up does not tend to arc over. Also, a complementary cut-out notch 56 is provided in the movable plate 42 around the area of post 48. This provides that post 48 is well isolated by means of the area reduction due to notch 56. The notch is disposed at the adjacent stop means 48 of the adjacent plate 40 and prevents any arcing over due to mineral build-up on post 48. Of course, any mineral build-up on post 48 may extend on to its adjacent plate 40 but will do little harm. To further isolate the chances of buildup, the ends 58 of the plates may be slanted away from the posts as shown.

The result of the above specific plate construction is that the area reducing arrangements for each plate, that is the space opposite extension 54 and the cut-out notch 56, cooperating with their opposite adjacent posts 50 and 48, respectively, is a very effective electrode construction. It inhibits the build-up of mineral deposits, which are inherent in an electrolytic iron, to form a path to short out the electrodes. The isolated position of the posts prevents the build-up of the mineral deposits or, if there is any build-up, there will be no shorting to the adjacent plate. Of course, the steam rate is determined by the electrode plates spacing, the plate size which is preferably flat as shown, and by the amount of electrolyte in solution.

While we have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

We claim:

1. In a lightweight electrolytic steam iron having a handle and a soleplate with steam distributing means for distributing steam therefrom, a casing of electrically non-conducting material forming the walls of an internal water tank coextensive with and over the soleplate, spaced electrodes supported within said tank for immersion in the water therein for generating steam from the water, and insulated steam conduit extending from the soleplate upwardly into said tank for directing saturated steam from said tank to said steam distributing means, the improvement wherein the spaced electrodes comprise, a pair of adjacent parallel electrode plates disposed in said tank and spaced from the tank walls and each other, said plates being movable relative to each other to adjust the spacing therebetween, means connected with said plates for selectively adjusting the spacing between said plates from the iron handle, separate spaced stop means on said tank walls limiting movement of each plate toward the other to avoid contact therebetween, one of said plates being shorter than the other so that an extension is defined on said other plate for contacting said stop means limiting the other plate movement, and a cut-out notch on said other plate opposite the stop means of said shorter plate preventing arcing from mineral deposits on said stop means of said shorter plate.

2. In a lightweight electrolytic steam iron having a handle and a soleplate with steam distributing means for distributing steam therefrom, a casing of electrically non-conducting material forming the walls of an internal water tank coextensive with and over the soleplate, spaced electrodes supported within said tank for immersion in the water therein for generating steam from the water, an insulated steam conduit extending from the soleplate upwardly into said tank for directing saturated steam from said tank to said steam distributing means, the improvement wherein the spaced electrodes comprise, a pair of adjacent parallel electrode plates disposed in said tank and spaced from the tank walls and each other, one of said plates being fixed in said tank and the other plate being mounted for movement relative to said fixed plate, means on said handle connected with said movable plate for selectively adjusting the spacing between said plates, separate spaced stop means on said tank walls limiting movement of each plate toward the other to avoid contact therebetween, and plate area-reducing means on each plate cooperatively disposed opposite the stop means limiting the other plate movement for preventing mineral build-up and arcing between said plates and stop means.

3. Apparatus as described in claim 2 wherein said plates are disposed to extend across said tank vertically with respect to the tank bottom and said movable plate is rotatable from a minimum spaced, maximum steam rate, position parallel with said fixed plate to an angularly spaced, lower steam rate, position.

4. Apparatus as described in claim 3 wherein said plates are of unequal size in area exposed to said water.

5. Apparatus as described in claim 4 wherein said fixed plate is shorter in length across said tank than said movable plate so that an extension is defined on said movable plate.

6. Apparatus as described in claim 5 wherein said stop means comprises spaced posts formed in said tank walls, said posts being disposed to abut the plates for limiting the minimum spacing to parallelism of said plates.

7. Apparatus as described in claim 6 wherein the posts are a pair of spaced posts with one being disposed abutting said movable plate on the extension thereof and the other post being disposed abutting said fixed plate, and a cut-out notch is provided in said movable plate opposite said other post, said extension and notch comprising plate area reducing means preventing mineral build-up and arcing between said plates and stop means.

* * * * *